US005226201A

United States Patent [19]

Lefebvre

[11] Patent Number: 5,226,201

[45] Date of Patent: Jul. 13, 1993

[54] DOOR STOP

[75] Inventor: Mario Lefebvre, 1951 rue de l'Elise, St. Eugene de Grantham, Quebec, Canada, J0C 1J0

[73] Assignee: Mario Lefebvre, St. Eugene de Grantham, Canada

[21] Appl. No.: 803,982

[22] Filed: Dec. 9, 1991

[51] Int. Cl.[5] ..... E05F 5/06

[52] U.S. Cl. ..... 16/86 A; 16/82; 16/83; 292/DIG. 15; 292/DIG. 19; 292/80; 292/87

[58] Field of Search ..... 16/82, 83, 86; 292/DIG. 15, DIG. 19, 80, 87

[56] References Cited

U.S. PATENT DOCUMENTS

| | | | |
|---|---|---|---|
| 355,852 | 1/1887 | Armstrong | 16/83 |
| 1,736,602 | 11/1929 | Kenerson | 292/80 |
| 1,922,676 | 8/1933 | Greene | 292/80 |
| 1,936,232 | 11/1933 | Greene | 292/80 |
| 2,189,274 | 2/1940 | Storrs, Jr. | 292/DIG. 15 |
| 4,134,608 | 1/1979 | Pool | 16/82 |

*Primary Examiner*—Donald Bray

[57] ABSTRACT

The invention provides an improved door stop which is adapted to retain a door in an open position, the door stop having a base which can be secured to a suitable wall or floor surface, a stopping portion which functions in the manner of a normal door stop, and a retaining member having an abutment formed therein to retain the door between the abutment and the stopping portion, the retaining member being moveable into and out of a door retaining position. The device permits a door to be opened and securely retained in an open position; the structure permits easy replacement of parts which can be sized to fit different doors.

5 Claims, 4 Drawing Sheets

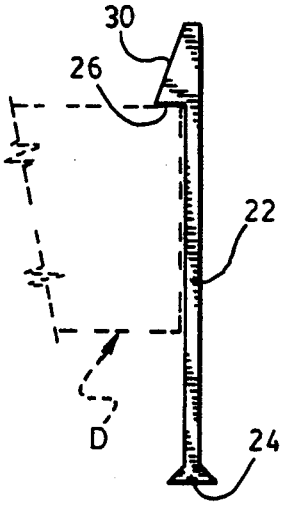
Fig.3a
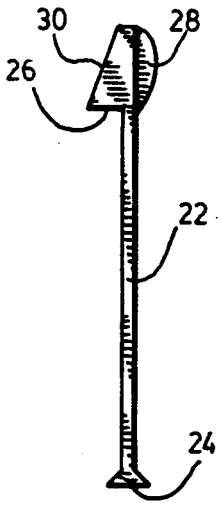
Fig.3b
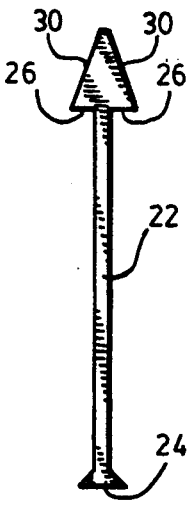
Fig.3c
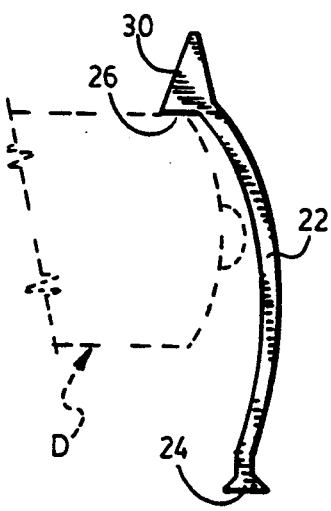
Fig.3d
Fig.4
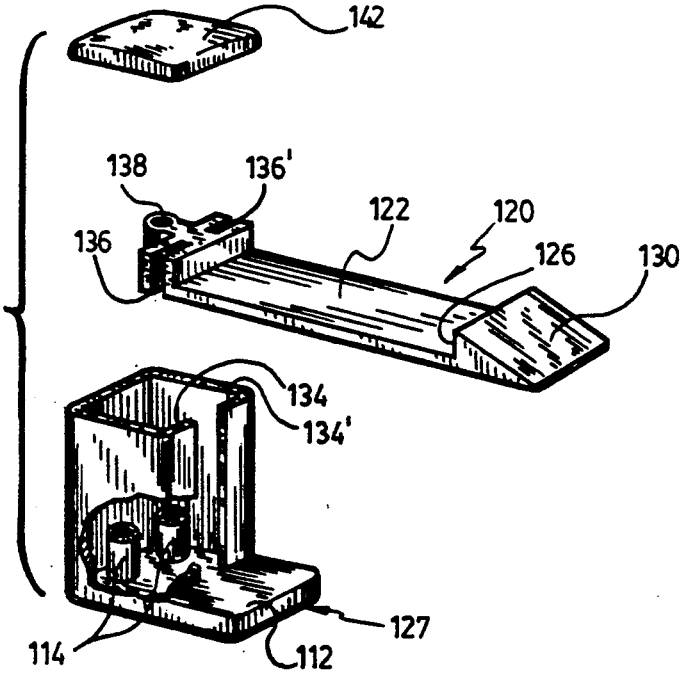

DOOR STOP

The present invention relates to door hardware and more particularly, relates to a door stop having door retaining means associated therewith.

Door stops are widely known in the art and have been used for a number of years. For example, it is well known to utilize a door stop to prevent the same from damaging walls or other objects when the door is opened. One common type of door stop has a base member secured to either the wall or floor and to which is attached the stopping member. The stopping member, in the case of a wall mount, may comprise an arm extending outwardly an appropriate distance with a rubber or other cushioning means on the end of the art which contacts the door. When the door stop is floor mounted, a similar type of arrangement is utilized except the door contacting member does not have to extend outwardly the same distance.

It has also been proposed in the art to include a door retaining means in association with the door stop. Typically, in the prior art, this has utilized an arrangement wherein the device frictionally engages the underside of the door once it has been opened to retain the same in the desired position. However, such members have not always functioned properly; unless the door is very carefully secured, often the door retaining member will not be operative. This is naturally a disadvantage of these prior art structures.

It is an object of the present invention to provide a door stop having retaining means associated therewith.

According to one aspect of the present invention, there is provided a door stop comprising a base member having means associated therewith for securing the base member to a surface, a stopping portion associated with the base member, and a retaining member attached to the base member, the retaining member having an abutment formed therein to thereby retain the door between the stopping portion and abutment, the retaining member being moveable into and out of a retaining position with respect to a door.

In greater detail, the door stop includes a base member which can be adapted to be secured either to a wall or the floor depending upon the particular situation. The means of securing the base member to the wall or floor may be by mechanical attachment means such as nails, screws, etc. or in the alternative, adhesive means may be employed including the common self sticking variety of adhesives.

The base member may be formed of any suitable material and may have any desired configuration according to the end use desired. Conventionally, it may be formed of a metallic or suitable plastic material.

The stopping portion is either attached to the base member or alternatively may be formed integrally therewith. The stopping portion is designed to prevent further movement of the door in a given direction. Stopping members per se are well known in the art and the member may be formed of a somewhat resilient or flexible material. Suitable materials include various rubber compounds and plastic material although it is also known in the art to use fabrics of a suitable thickness to provide the cushioning effect.

The stopping portion, as aforementioned, is formed integrally with the base member or in the case of it being separate, and many different means for attachment may be employed. Preferably, a mechanical attachment is employed for the sake of convenience.

The retaining member may either be a separate member or it may be formed integrally with the stopping member and/or the base member. Various combinations may be utilized as will be apparent to those knowledgeable in the art.

The retaining member has an abutment formed therein to define a recess, the recess being of a suitable depth and of a width adaptable such that the thickness of the door to be retained fits comfortably therein. Normally, the recess will be sized (width) to be somewhat larger than the thickness of the door to provide the necessary leeway to ensure that the door fits within the recess without precise placement thereof.

In order to ensure that the door fits within the recess in a convenient manner, the retaining member is formed such that it is moveable into and out of a door retaining position. In order to accomplish this, the retaining member is either itself flexible or mounted in a flexible manner such that it may move into and out of the desired position. In one embodiment, wherein the retaining member is formed of a suitably flexible material (such as a plastics material) the retaining member will have a overall arrow-like configuration such that the door will contact a sloping surface and the retaining member will flex to permit the door to continue movement to the stopping member following which the abutment will engage the door to prevent further movement thereof.

As previously mentioned, the retaining member itself may be flexible or if it is of a rigid material, it is mounted such that movement thereof is permitted. This may be accomplished by a suitable mounting utilizing a spring arrangement whereby once the door contacts the front surface of the retaining member, it would be allowed to move to permit passage of the door following which a spring member would urge the retaining member into its retaining position such that the recess would engage the door and an abutment on the retaining member would prevent further movement of the door.

The retaining member may assume various configurations and in a desired embodiment, the retaining member is formed as a separate member which may be easily replaced. This has the advantage of allowing replacement in case of breakage but also permits easy and inexpensive replacement of a portion of the device and which portion will control several factors. For example, the retaining member could easily be replaced if desired for a different door thickness. Similarly, different lengths of the retaining member may be utilized in order to retain the door in different positions. Furthermore, the retaining member may have two sides to adapt for different door thicknesses to provide more flexibility for such a device. Furthermore, the retaining member may be designed such that the entire unit may be sold with the retaining member being sized by the end user for the desired distance which one wants to hold the door from a surface. This embodiment would be particularly advantageous in the case of a wall mount since the end user does not have the option of locating it at a certain distance as is the case with a floor mount.

Having thus generally described the invention, reference will be made to the accompanying drawings, illustrating an embodiment thereof, in which:

FIGS. 3A to 3D are top views illustrating various configurations of a retaining member;

FIG. 4 is a perspective view of a further embodiment of a disassembled device;

Figure 1:
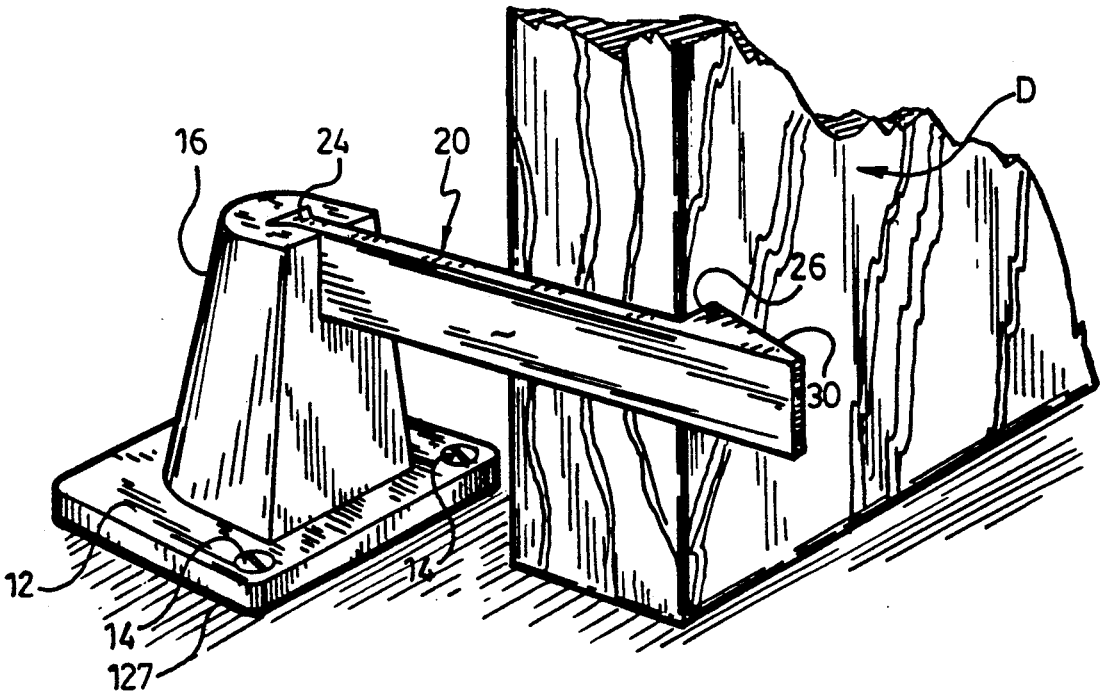
FIG. 1 is perspective view illustrating mounting of the device on the floor and engagement thereof with a door.
Figure 2:
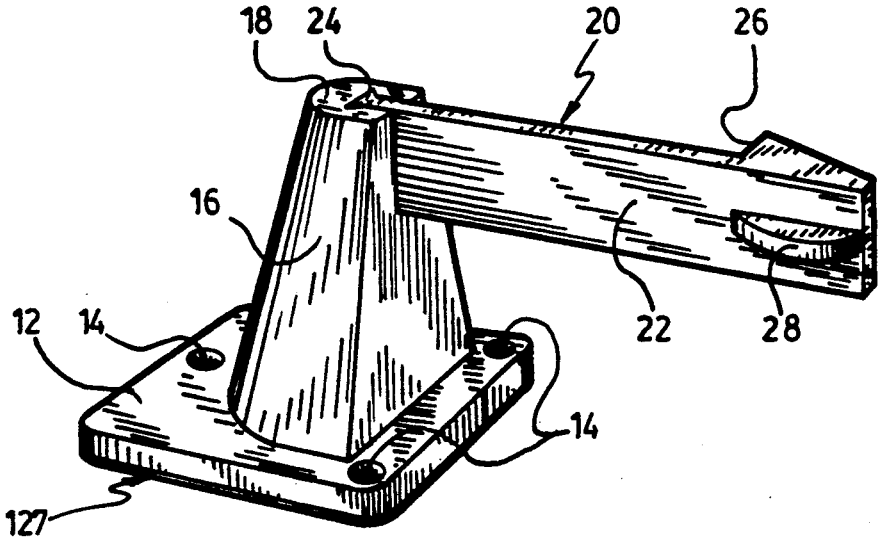
FIG. 2 is a perspective view of an assembled device.

Referring to the drawings in greater detail and by reference characters thereto, there is provided a door stop device generally designated by reference numeral 10 in FIGS. 1 and 2; door stop device 10 is adapted to retain door D in a desired open position.

Device 10 includes a base member 12 having a plurality of apertures 14 therein for securing the same to a surface—in the illustrated embodiment, to a floor. Suitable screws (not shown) may be employed to secure base member 12 to the floor. Alternatively, the bottom surface of base member 12 may be provided with adhesive for securing the same.

A stopping portion 16 extends upwardly from the base. In the illustrated embodiment, stopping portion 16 is a solid member formed integrally with base 12. A trapezoidally shaped recess 18 is provided in the upper portion of stopping portion 16 as will be apparent hereinbelow.

A retaining member 20 has an arm 22 with a first end of the arm having a trapezoidally shaped locking portion 24 which fits within recess 18 to lock the member in the desired position. At the other extremity of arm 22 there is provided a sloping surface 30 merging with an abutment 26. As may be seen from FIG. 1, the device is positioned such that a door, after being opened, will engage sloping surface 30 causing arm 22 to flex and the door will subsequently engage stopping portion 16. At this point, the flexible arm 22 will cause abutment 26 to engage a side portion of the door to keep it in its desired position.

Abutment 28 on the opposite side of arm 22 from abutment 26 illustrates that several different configurations may be utilized. Thus, referring to FIG. 3, abutments of different configurations are illustrated—FIG. 3A showing abutment 26 similar to that described with FIGS. 1 and 2, FIG. 3B illustrating an abutment having a somewhat convex configuration; FIG. 3C showing a symmetrical retaining member 20; and FIG. 3D showing a member having a curved arm portion to operate with a door having a convex end portion.

Figure 5:
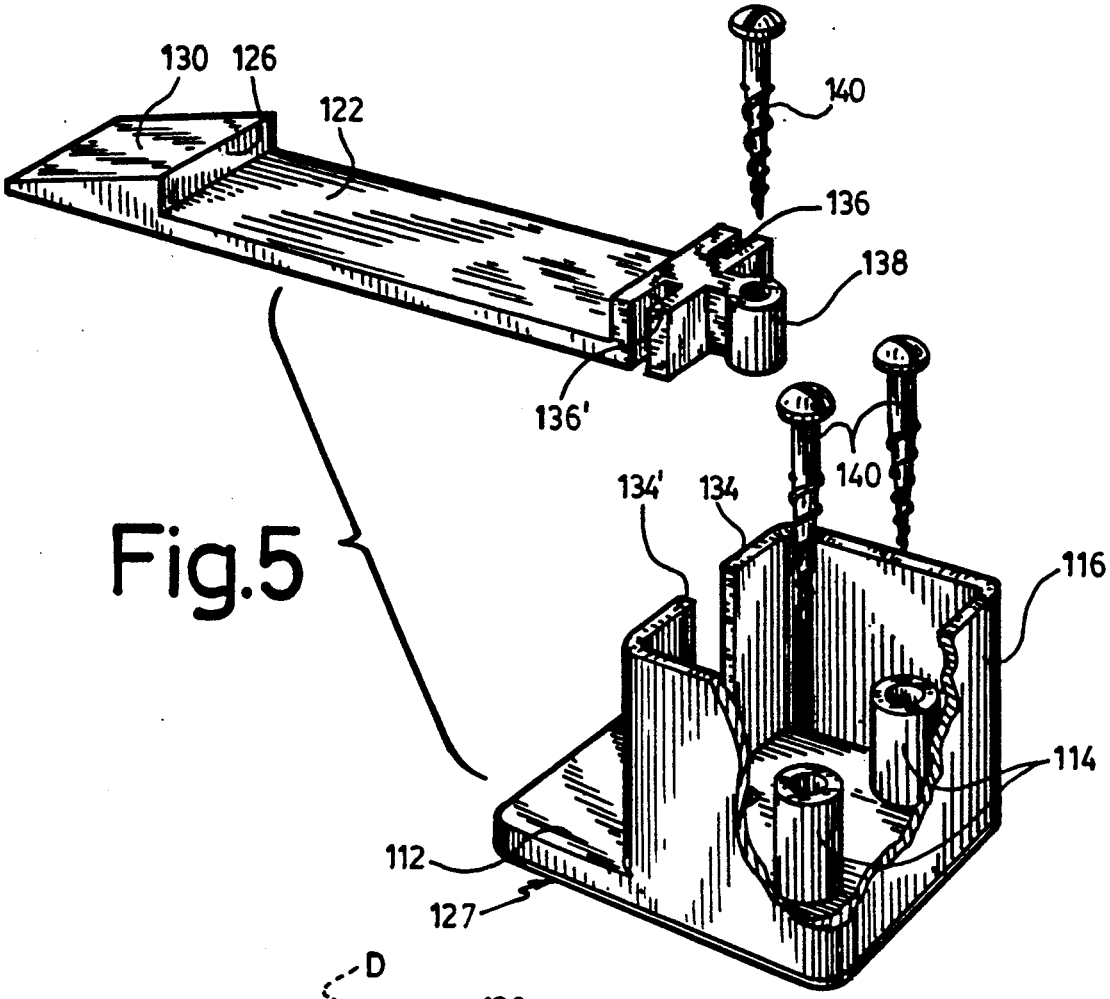
FIG. 5 is a further perspective view illustrating the device of the present invention.
Figure 6:
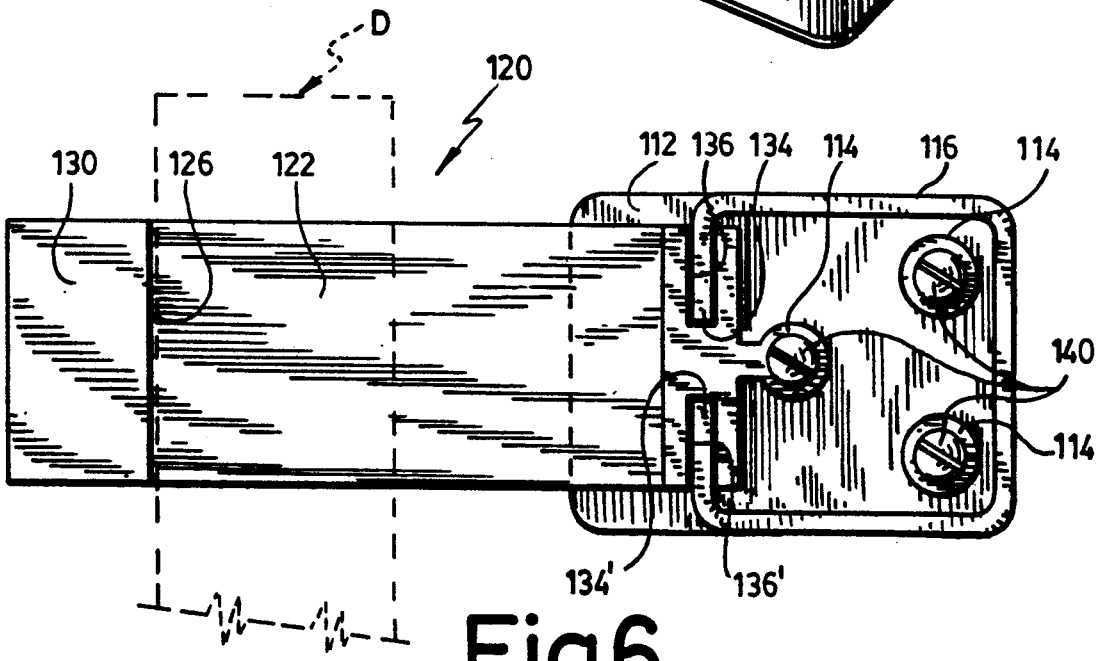
FIG. 6 is a perspective view of the assembled device.
Figure 7:
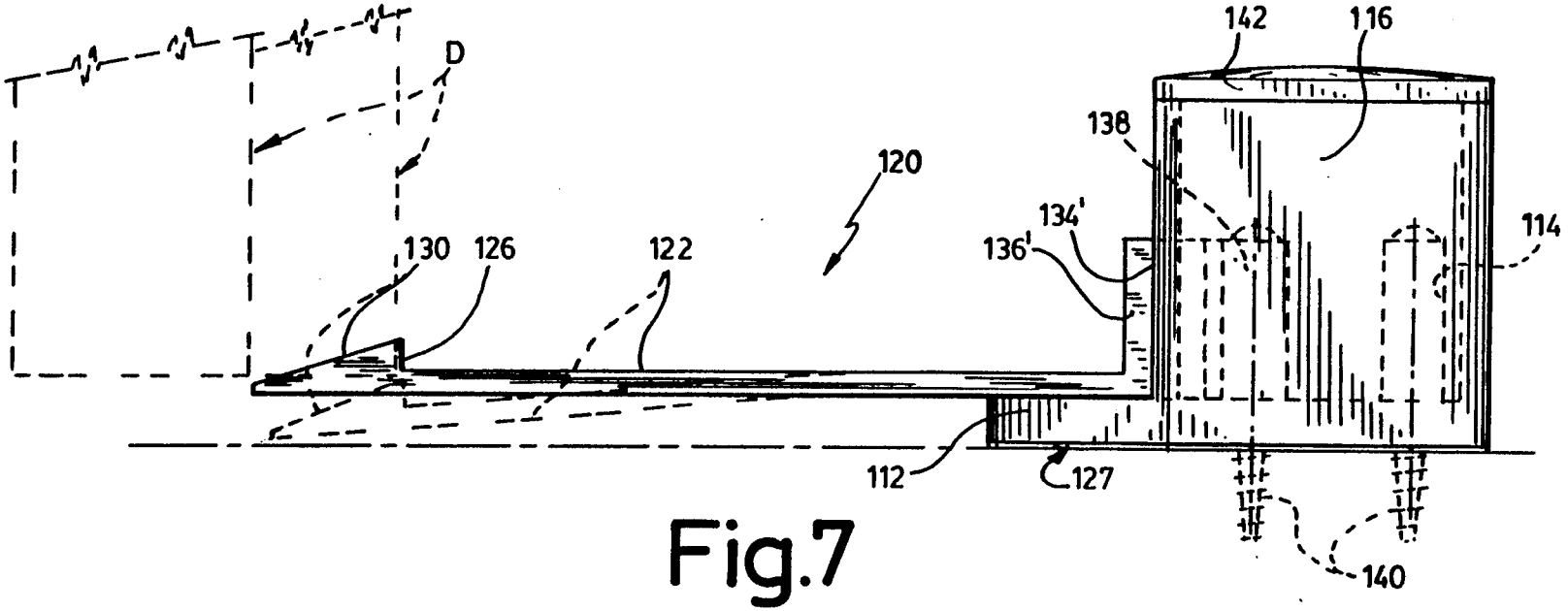
FIG. 7 is a further perspective view thereof.

In FIGS. 4 and 5, a somewhat similar arrangement is shown. In this embodiment, a door stop device 110 has a base portion 112 and a stopping portion 116. Apertures 114 have a raised portion 115. Stopping portion 116 is a hollow structure and a pair of inwardly extending walls 134 and 134' provide a space between them. Retaining member 120 has an arm portion 122 and a pair of grooves 136 and 136' are provided for engaging walls 134 and 134' respectively and thus providing the interconnection between retaining member 120 and stopping portion 116. Retaining member 120 includes an extended portion generally designated by reference numeral 138 which has an aperture therethrough to receive an adjustment screw 140. Adjustment screw 140 will control the distance which retaining member 120 is spaced from base portion 12 and thus control the height of retaining member 120. In this embodiment, retaining member 120 is adapted to function to retain the bottom of a door. A cover member 140 fits over the top of stopping portion 116 to prevent further adjustment of screw 140.

Figure 8:
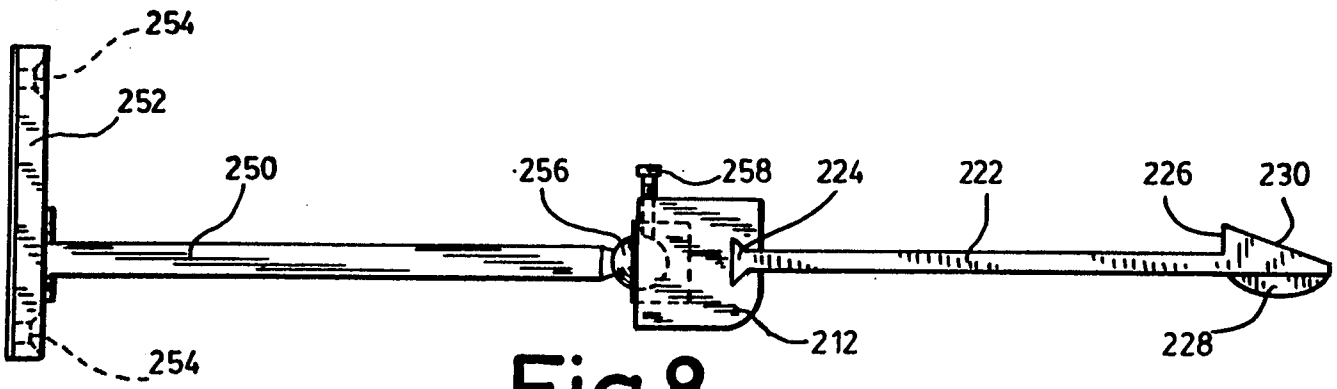
FIG. 8 is a top view of a further embodiment of the invention.

Referring to FIG. 8, an embodiment similar to that of FIGS. 1 and 2 is illustrated. In this embodiment, there is provided an extender arm 250 secured to a plate 252 which in turn is secured to a wall surface by screws 254. Extender arm 250 has a spherical portion 256 at the opposed end. Base portion 212 of the door stop device includes at least one set screw 258 for securing the base 212 to the extender arm.

It will be understood that the above described embodiment is for purposes of illustration only and that changes and modifications may be made thereto without departing from the spirit and scope of the invention.

I claim:

1. A door stop device adapted to retain a door in an open position comprising a base member having means associated therewith for securing said base member to a surface, said base member having a stopping portion associated therewith, a retaining member attached to said base member, said retaining member having an abutment formed therein to retain the door between the abutment and said stopping portion, said retaining member being formed of a flexible material to permit movement into and out of a door retaining position, said retaining member being secured to said base member by interlocking means.

2. The device of claim 1 wherein said stopping portion and said base member are integrally formed, said base member having at least one aperture formed therein for securement to a surface.

3. The device of claim 1 wherein said retaining member has adjustment means for locating said retaining member with respect to said base member.

4. The device of claim 1 wherein said retaining member has a sloping surface adapted to engage the edge of a door, said sloping surface merging with said abutment which retains the door in a desired position.

5. The device of claim 1 wherein said base member includes a self-sticking material for securement to a surface.

* * * * *